United States Patent [19]

Richert

[11] 4,383,232

[45] May 10, 1983

[54] LOW PROFILE RELAY

[75] Inventor: Walter J. Richert, Princeton, Ind.

[73] Assignee: AMF Incorporated, White Plains, N.Y.

[21] Appl. No.: 314,328

[22] Filed: Oct. 23, 1981

[51] Int. Cl.[3] ..... H01H 50/04

[52] U.S. Cl. ..... 335/202; 335/129

[58] Field of Search ..... 335/202, 106, 128, 129, 335/203, 132, 187, 115, 126, 192

[56] References Cited

U.S. PATENT DOCUMENTS 3,553,729 1/1971 Mori et al. ..... 335/106

4,010,433 3/1977 Nishimura et al. ..... 335/202

*Primary Examiner*—Harold Broome

*Attorney, Agent, or Firm*—David E. Dougherty; Charles J. Worth

[57] ABSTRACT

A miniature low profile relay having discrete bobbin and stationary contact block sections mechanically affixed together. A closed-loop pusher member having a window portion is interposed between the bobbin and stationary contact block sections. A tongue portion of the stationary contact block section extends through the window of the pusher for being received in force-fit within a recess portion of the bobbin section. An E-core having a center arm which extends through the bobbin section with a protruding end portion and having two outer arms having end portions, with each end portion being received in a slot of the contact block section.

8 Claims, 17 Drawing Figures

LOW PROFILE RELAY

FIELD OF THE INVENTION

The invention relates to an electromagnetic relay using a flat type electromagnet and formed to be generally flat as a whole and, more particularly, to a low profile relay adapted for mounting on printed circuit boards.

BACKGROUND OF THE INVENTION

Conventional low profile type relays have in general the below enumerated defects in their structures.

First, particularly in miniature relays in which a unitary bobbin and terminal section is utilized with stationary arms and coil terminals insert molded therein, either the coil is wound after the contacts are welded, which can cause the contacts to be deformed or contaminated, or the contacts are welded after the coil is wound, which can cause damage to the coil resulting from the welding operation. Also, particular care must be exercised during soldering to prevent melting of the plastic around the terminals which can cause them to loosen. It can be appreciated that the above considerations/care will necessarily increase mass manufacturing costs.

Second, the conventional relays have also a defect in that the card or pusher member is of a generally U-shape which is relatively weak structurally and, therefore, subject to warpage.

Prior art devices of interest are described in: U.S. Pat. Nos. 3,553,729 issued Jan. 5, 1971 to Tetsuo Mori et al: 4,010,433 issued Mar. 1, 1977 to Hiromi Nishimura et al; 3,501,719 issued Mar. 17, 1970 to W. J. Richert; 4,041,425 issued Aug. 9, 1977 to Douglas J. Brush et al; 3,701,062 issued October 1972 to Koga et al; 4,008,447 issued February 1977 to Anderson et al; and 4,112,400 issued September 1978 to Jaidinger et al.

The teachings of the above noted patents are incorporated into the disclosure of the present invention to the extent necessary.

The above patents are mentioned as being representative of the prior art and other pertinent references may exist. None of the above noted patents are deemed to affect the patentability of the present claimed invention.

In contrast to the prior art, the present invention provides a relay which utilizes discrete bobbin and contact block sections which are mechanically affixed together during assembly with a closed-loop pusher member mounted therebetween, reduces component warpage, reduces skill or care required during soldering or welding to prevent component damage, is adapted for ease of assembly and involves a minimum of associated parts.

SUMMARY OF THE INVENTION

Generally speaking, the present invention relates to a low profile relay comprising an E-shaped yoke having a center leg and two side legs each spaced from and parallel with a side of the center leg, a discrete bobbin of electrically insulating material with a yoke exciting coil wound therearound, a pusher or card member having a generally rectangular body portion with a window, a discrete contact block having a cantilevered stationary contact extended therefrom and a tongue member projected through the pusher window and mechanically secured to the bobbin, a first movable contact means biased for contacting the stationary contact with the pusher being in a first position and disposed from contact with the stationary contact with the pusher being in a second position.

A further feature of the present invention involves three slots in the stationary contact block each for receiving an end of a respective leg of the E-shaped yoke.

Another feature of the present invention comprises a stop tab at the upper edge of the pusher member for defining the upper travel of the armature.

The present invention has been suggested to eliminate the above mentioned defects of the prior art relays.

Accordingly, it is an object of the present invention to provide a new and improved low profile relay assembly.

Another object of the present invention is to provide discrete bobbin and stationary contact block sections which can be easily mechanically affixed together.

Another object of the present invention is to provide a pusher or card having improved structural strength.

Another object of the present invention is to provide a relay assembly which eliminates component damage during welding/soldering operations.

BRIEF DESCRIPTION OF THE DRAWINGS

Other objects and advantages of the invention may be more clearly seen when reviewed in conjunction with the accompanying drawings. Similar reference numerals refer to similar parts throughout.

DETAILED DESCRIPTION OF THE INVENTION

Figure 1:
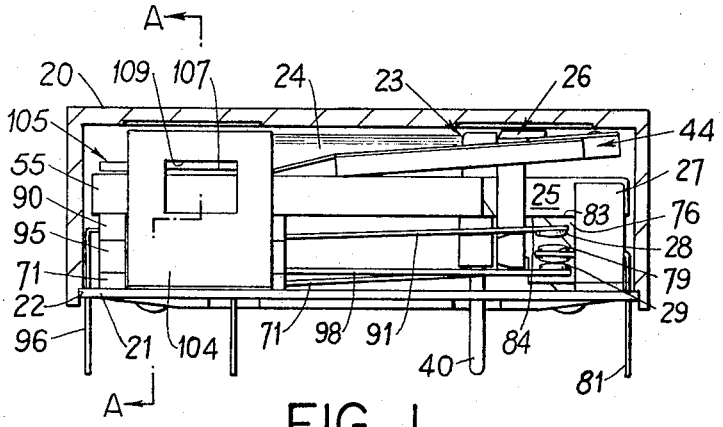
FIG. 1 is a side view of the relay of the present invention.
Figure 1B:
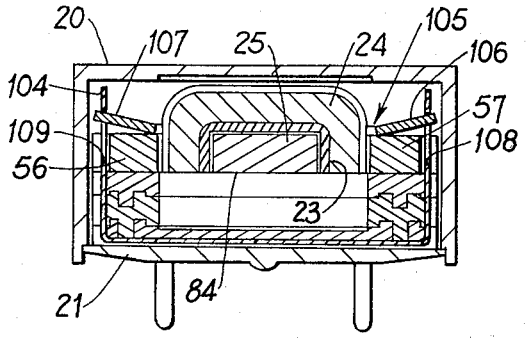
FIG. 1*b* is a section of the relay shown in FIG. 1 taken along A—A.
Figure 1A:
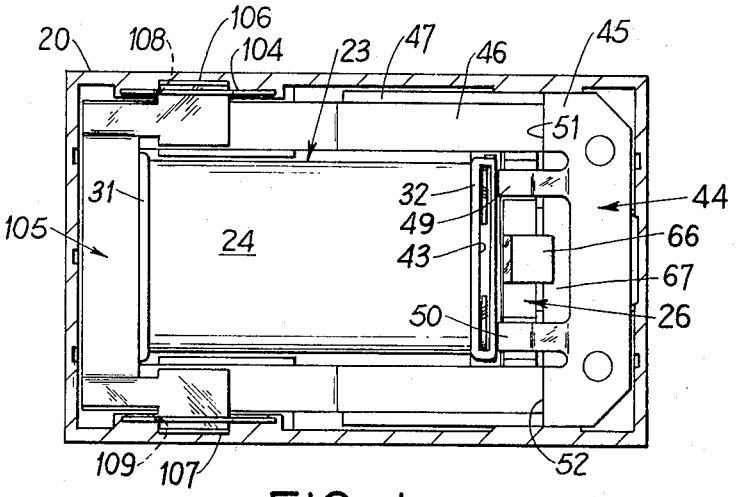
FIG. 1*a* is a top view of the relay shown without the cover.
Figure 2:
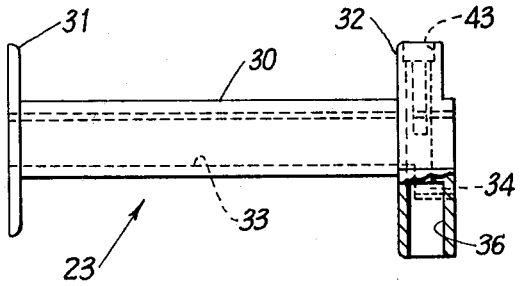
FIG. 2 is a side view partly cutaway of the bobbin section in accordance with the present invention.
Figure 2A:
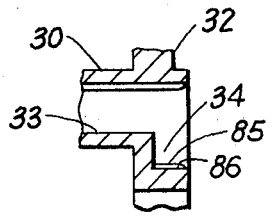
FIG. 2*a* is a cutaway section view of an end of the bobbin in accordance with the present invention.

With reference to FIGS. 1, 1*a* and 1*b*, the preferred embodiment of a flat pack relay having a configuration made in accordance with the present invention comprises a cover 20 open at one end and a header or support plate 21 received in slot means 22 of cover 20, a bobbin 23 having a coil 24 wound therearound for exciting the yoke 25, a pusher or card member 26, a stationary contact block 27, and an upper and a lower movable contacts 28 and 29, respectively.

Figure 3:
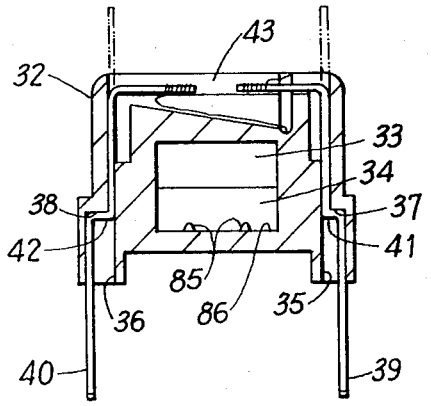
FIG. 3 is an end view in section of the bobbin with coil terminals.
Figure 4:
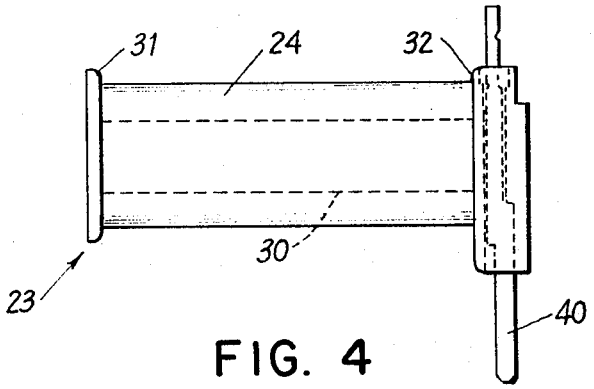
FIG. 4 is a side view of the bobbin showing a coil terminal disposed within a slot of the bobbin in accordance with the invention.

With reference now to FIGS. 1 through 4, the discrete bobbin member 23 includes an elongate rectangular shaped spool member 30 which has a rim or ridge 31 and 32 at each end and a rectangular axial hole 33 dimensioned to receive the center leg 25 of the E-shaped yoke. Ridge 32 is relatively wide in thickness and includes a slot 34 open on one side with the rectangular axial hole 33 so as to form an enlarged opening at the end facing the stationary contact block 27. A coil terminal slot 35 and 36 is formed on each side of bobbin ridge or end wall 32 and includes a shoulder portion 37 and 38, respectively. A start and a finish coil terminal 39 and 40 are inserted from the bottom-up into the terminal slots 35 and 36, respectively. Each coil terminal 39 and 40 includes an intermediate bent portion 41 and 42 which abuts against a respective shoulder portion 37 and 38 of the bobbin end wall 32, thereby, forming an insert stop and terminal positioning guide assembly means. The start and finish leads of the yoke exciting coil 24 are wrapped around a respective upper end portion of coil terminals 40 and 39. The start and finish leads are then soldered to the coil terminals 40 and 39, respectively, which are next bent into a groove 43 in the bobbin end wall 32 as shown in FIG. 3.

Figure 5:
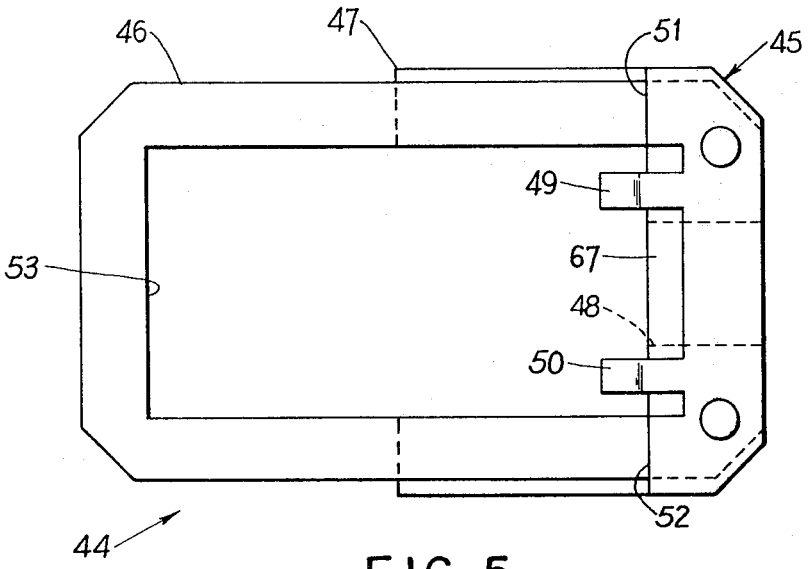
FIG. 5 is a top view of the armature assembly.
Figure 5A:
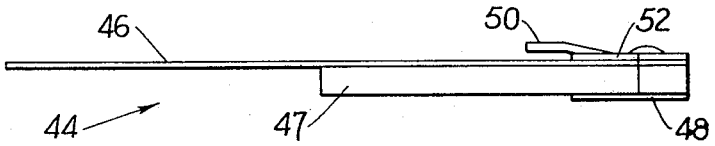
FIG. 5*a* is a side view of the armature assembly.

The armature assembly will now be described with reference to FIGS. 1, 5 and 5*a*. The armature assembly 44 comprises in a sandwich-like arrangement an actuator 45, a generally rectangular spring 46, an armature 47 and a residual plate 48. The actuator 45 has a generally U-shaped body portion with two actuator arms 49 and 50 inwardly directed and spaced between the end legs 51 and 52 of the U-shaped body portion. The actuator arms 49 and 50 are bent upward and have a ledge or end portion which engages shoulder portions of the card 26 for urging the card in a downward direction when the yoke 25 has been excited to attract the armature 47. The spring 46 basically comprises a flat plate type hinging spring for the armature and has a window 53 in its center dimensioned to fit over the bobbin 23 and card 26 components of the relay assembly. The armature 47 is formed of a magnetic material and generally is U-shaped. A residual plate 48 is affixed to the armature 47 to reduce sticking of the armature 47 in the actuated position.

Figure 6:
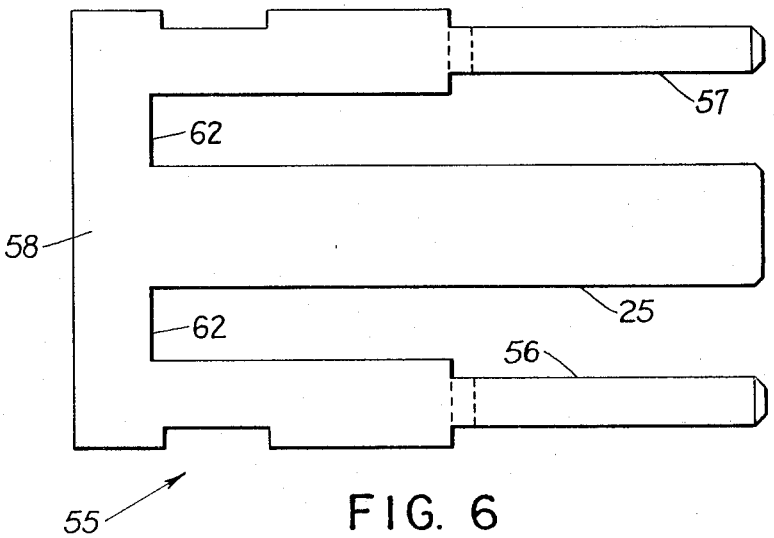
FIG. 6 is a top view of the E-shaped core.

With reference to FIG. 1, 1*a* and 6, the yoke or core 55 is formed of a flate plate of magnetic material to be generally E-shaped with a center arm 25 and a pair of outer arms 56 and 57 which are spaced from and are substantially parallel to one another and to the center arm 25, and a bight portion 58 connecting corresponding ends of the arm portions together. The outer arms 56 and 57 are dimensioned to extend from the bight portion to the stationary contact block 27 with their free ends being of reduced size and adapted to fit within respective mounting holes 59 and 60 formed in the stationary contact block 27. The center arm 25 of the yoke 55 generally has an elongate rectangular shape dimensioned to be received within the axial hole 33 through the bobbin 23 with its free end being received in a slot or cut-out 61 in the stationary contact block 27. Edge portion 62 of the yoke 27 abuts or is juxtaposed with the end wall 31 of the bobbin 23. The receiving holes 59 and 60 and/or slot 61 may be dimensioned so as to require the respective free ends of the arms 56, 57 and 25 to be force fitted therein. In this manner, a mechanical mounting arrangement is provided between the yoke 55 and the stationary contact block 27.

Figure 7:
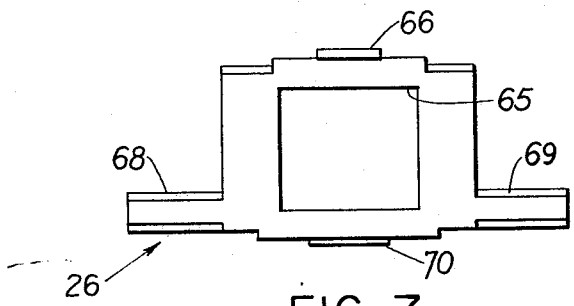
FIG. 7 is a side view of the pusher or card in accordance with the invention.
Figure 8:
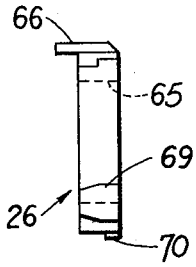
FIG. 8 is an end view of the card.

The pusher or card member 26, see FIGS. 7 and 8, is formed of a synthetic resin or plastic of an electrically insulating material, generally having a closed-loop configuration defining a window portion 65 for receiving a tongue portion (more fully described hereinafter) of the stationary contact block 27 therein. A positive armature stop projection 66 is provided at the top of the pusher 26 which, with the relay in the assembled but unenergized state, engages a portion 67 of the armature 47 between arms 49 and 50 of the actuator to define the upward travel of the armature assembly 44. A lateral projection 68 and 69 is provided on respective sides of the base of the pusher 26 each dimensioned for being interposed between a set of upper and lower movable contacts. A tab 70 is provided on the bottom of the pusher 26 which is received in a slot (not shown) in the free end of return spring 71 (see FIG. 1).

Figure 9:
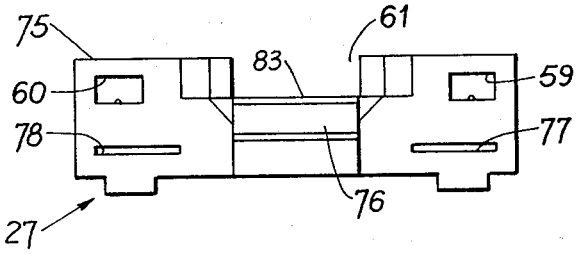
FIG. 9 is a side view of the stationary contact holder block in accordance with the invention.
Figure 9A:
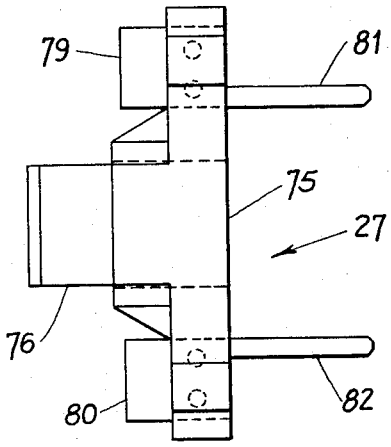
FIG. 9*a* is a bottom view of the stationary contact holder block.
Figure 9B:
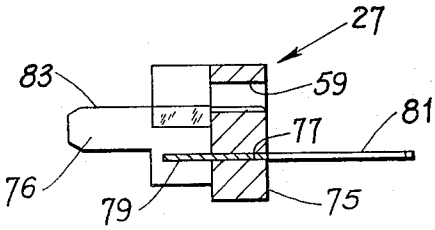
FIG. 9*b* is an end view partly cutaway of the stationary contact holder block.

With reference now to FIGS. 9, 9*a* and 9*b*, the discrete stationary contact block 27 is formed, for example, of an electrically insulative plastic to have a substantially rectangular shaped body portion 75 with a generally central cut out or notch 61 sized to receive the free end of the center arm 25 of the E-shaped yoke 55. A window or slot 59 and 60 is provided on each side of the notch 61 and aligned therewith for accommodating a respective free end of the outer arms 56 and 57 of yoke 55. A tongue portion 76 substantially of rectangular shape is also provided below and in vertical alignment with notch 61 and projects toward the bobbin member 23. Further, two spaced apart slots 77 and 78 are provided for mountingly receiving a respective stationary contact 79 and 80 therein. Each stationary contact 79 and 80 includes a cantilevered arm portion which projects inwardly in the direction of the bobbin 23 projecting contacts (not shown) and a terminal member 81 and 82 that extends from the other side of the contact block 27. The terminal members 81 and 82 are bent downward during assembly to extend through hole portions in the support plate 21. The tongue 76 is dimensioned to extend through the card window 65 and be received in force fit within slot 34 of the bobbin 23 with its upper surface 83 in force fit engagement with the lower surface 84 of the center arm 25 of yoke 55 generally within the adjoining space between slots 33 and 34 of bobbin 23.

It should now be appreciated that during assembly the center arm 25 of E-shaped core 55 is inserted within the axial hole 33 of the bobbin 23 such that the free ends of the arms 25, 56 and 57 extend past bobbin end wall 32. The card member 26 is then positioned in juxtaposition to end wall 32 with center arm 25 projecting through window 65 and projections 68 and 69 of pusher member 26 disposed sidewardly below center arm 25. The stationary contact block 27 is then mounted to the bobbin 23 with the tongue portion 76 projecting through window 65 and force fitted between the detent bumps 85 on the bottom surface 86 of slot 34 and the lower surface 84 of center arm 25. The free ends of arms 56, 25 and 57 are received within slots 59, 60 and 61 respectively. And as noted above, the dimensions of the slot 59, 60, and 61 may be adapted to receive the respective free ends of the yoke arms 56, 25 and 57 in force fit to provide additional mechanical mounting fixture. Thus, the closed loop shaped pusher member 26 is trap mounted between the discrete bobbin 23 and contact block 27 so as to be upwardly-downwardly movable. A bonding material may be used to cement the free ends of arms 56, 25 and 57 within the respective slots 59, 60 and 61. From the above it should further be recognized that in accordance with the teachings of the present invention that the discrete components including the bobbin 23, the E-shaped yoke 55, pusher member 26 and stationary contact block 27 form a mechanically held together relay subassembly.

Figure 10:
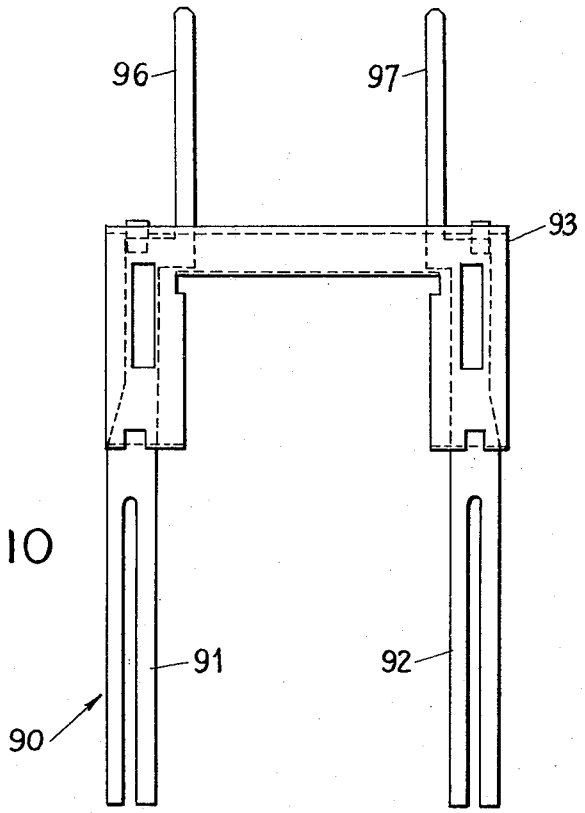
FIG. 10 is a top view of the upper movable contact block.
Figure 11:
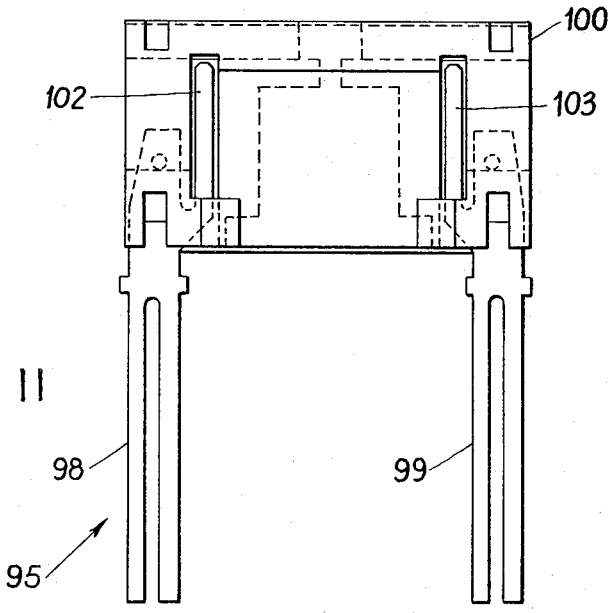
FIG. 11 is a top view of the lower movable contact block.

With reference now to FIG. 10, the upper contact block 90 is shown to comprise a set of bifurcated contact spring blades 91 and 92 having free ends which contain downwardly projecting contacts (not shown) in spaced alignment for contacting a respective stationary contact 80 and 79 with downward travel of the pusher member 26 (see FIG. 1). The spring blades 91 and 92 are mounted in an encapsulation block 93 formed of insulating plastic material for being mounted in sandwich like manner between the E-shaped yoke 55 and a lower encapsulation block 95. The spring blades 91 and 92 include respective contact terminals 96 and 97 which are bent downwardly to extend through an opening in the bottom support plate 21.

The lower encapsulation block 95 includes a set of bifurcated spring blades 98 and 99 generally in vertical alignment with spring blades 91 and 92, respectively, each having free ends which contain upwardly projecting contacts (not shown) adapted for contacting the lower surface of stationary contacts 80 and 79, respectively, with upward travel of the pusher member 26. The spring blades 98 and 99 are mounted in an encapsulation block 100 formed of insulating plastic material for being mounted in sandwich like manner between the upper block 90 and the return spring 71 (see FIG. 1). The spring blades 98 and 99 include respective contact terminals 102 and 103 which are bent downwardly to extend through an opening to the bottom support plate 21.

The return spring 71 is formed of spring metal and includes a free end which is biased against a lower portion of the pusher member 26 for urging same in an upward direction.

The relay assembly may be held in the sandwich like arrangement by any conventional means such as by a U-shaped clamping metal piece 104 having upstanding side walls and a retaining plate 105 having laterally projecting members 106 and 107 which are received in respective slots 108 and 109 in the side wall, such as is shown in U.S. Pat. No. 3,553,729 issued Jan. 5, 1971 to Mori et al.

In operation, the upper contacts, for example, 28 on the ends of blades 91 and 92 are caused to disengage from contact with the respective stationary contacts, for example, 79 under the spring bias of return spring 71, with the relay in the unenergized state. With the relay being energized, the armature assembly is cause to move downwardly against the bias of return spring 71 to, thereby, cause the lower contacts, for example, 29 to disengage from contact with respective stationary contacts, for example 79 while the upper contacts are brought into contact with the respective stationary contact.

While the invention has been described with respect to a preferred embodiment, it should be apparent to those skilled in the art that modifications may be made thereto, without departing from the spirit and scope of the invention.

I claim:

1. A relay of the type having an E-shaped yoke with a center arm and two side arms each spaced at a side of the center arm, a pusher member movable with an armature, and having a first and a second movable contact each disposed on a side of a stationary contact and each being movable with the pusher member for being brought into and out of contact with the stationary contact, wherein the improvement comprises:

a discrete bobbin having a yoke exciting coil wound therearound, and having a hole into which said center leg of the yoke is inserted, and having an end wall having a slot;

a pusher member having a hole therein; and a discrete stationary contact block having said stationary contacts mounted thereto, and having a projection portion which extends through the hole in said pusher member and being received in the end wall slot in the bobbin.

2. A relay as in claim 1, wherein:

the slot in the end wall of the bobbin is dimensioned to require said projection portion of the stationary contact block to be received in force fit whereby said bobbin and stationary contact block are mechanically secured together.

3. A relay as in claim 1, wherein:

the slot and the hole at the end wall of the bobbin have a common boundary defining an enlarged recess within said end wall;

the center arm of the E-shaped yoke includes a free end which extends without said bobbin; and the stationary contact block includes a slot for receiving the free end of said center arm, and the projection portion extends generally in juxtaposition with the center arm and is received in force fit between a portion of the slot and a portion of the center arm.

4. A relay as in claim 3, wherein:

the slot includes a detent bump whereby the force fit between said center arm and the projection portion of the stationary contact block is effected.

5. A relay as in claim 1, wherein:

the center and two side arms of the E-shaped yoke each have a free end portion that extends past the end wall of the bobbin and are received in respective slots in the stationary contact block.

6. A relay as in claim 1, wherein:

the pusher member has a closed-loop configuration defining a hole therein for receiving the projection portion of the stationary contact block whereby the pusher member is upwardly and downwardly trap mounted between the bobbin and the stationary contact blocks.

7. A relay as in claim 6, wherein the pusher member includes an armature stop boss integrally formed on an upper edge thereof, and having a laterally projecting arm means extending from a side of the base of the pusher member and being a portion for causing said first and second movable contacts to engage and disengage the stationary contact with upward and downward movement of the pusher member.

8. An electromagnetic relay comprising:

an E-shaped yoke having a center leg and two side legs each spaced from and generally parallel with a side of the center leg, each leg having a free end and being interconnected by a joining portion;

a discretely formed bobbin of electrically insulating material having a generally elongate rectangular shaped spool member with a yoke exciting coil wound therearound and confined between a first and a second end wall, said bobbin having a yoke receiving hole therein dimensioned for receiving the center leg of the yoke wherein the free ends of the yoke legs project past said second end wall with said joining portion of the yoke disposed in juxtaposition with said first wall, said second end wall having a recess defined in part by the yoke receiving hole and in part by an adjoining slot in the second end wall and having two coil terminals each disposed in a receiving alcove formed in a portion of said second end wall;

discretely formed card made of electrically insulating material generally having a rectangular shaped body portion having a hole therein, and having a projection laterally extending at a side of the base, and having an armature stop projection integrally formed at a top side, said card being disposed vertically in upward and downward movable manner adjacent the second end wall of said bobbin wherein said center arm of the yoke extends through the hole in the card, a discretely formed stationary contact block formed of electrically insulative material having a generally rectangular shaped body portion with a recess in a top side dimensioned to receive the free end of said center arm, and having two spaced apart holes each aligned and dimensioned for receiving a respective free end of the side arms of said yoke, and having a generally rectangular shaped tongue portion vertically aligned below the recess in the top side and extending substantially in parallel juxtaposition below the center arm through the hole in the card, said tongue having an end portion received in the recess in the second end wall of the bobbin in force fit between a portion of said bobbin and a portion of the center leg of the yoke wherein said bobbin and said stationary contact block are mechanically secured together with the card interposed therebetween, and having a stationary contact extending in a direction toward the bobbin;

a first spring blade disposed at one side of the base projection of said card and having a free end containing a movable contact aligned for contacting said stationary contact under the spring bias of said first spring blade with said card disposed to a first vertical position;

a second spring blade disposed at the other side of the base projection of said card and having a free end containing a movable contact aligned for contacting said stationary contact under the spring bias of said second spring blade with said card disposed to a second vertical position;

an armature assembly resiliently held spaced from the yoke by means of a biasing means, said armature assembly having an armature at its free end and a card pusher arm means, and having a ledge portion aligned for contacting said armature stop projection to define the upper most position of said armature assembly; and biasing means for urging said card into said second vertical position;

wherein with said card being disposed into said first vertical position by means of said pusher arm means with the armature being attracted to the yoke with an excitation of the coil, thereby the base projection of said card being downwardly disposed so as to both enable said first spring blade to urge its movable contact into engagement with the stationary contact and to contact said second spring blade causing downward displacement of its movable contact out of engagement with said stationary contact, and with deenergization of the yoke said card being disposed into said second vertical position under influence of said biasing means whereby the base projection of the card being upwardly disposed so as to enable said second spring blade to urge its movable contact into engagement with the stationary contact and to contact said first spring blade causing upward displacement of its movable contact out of engagement with said stationary contact.

* * * * *